US009142871B2

(12) United States Patent
Sun et al.

(10) Patent No.: US 9,142,871 B2
(45) Date of Patent: Sep. 22, 2015

(54) INNER CONNECTING ELEMENT OF A CAVITY POWER DIVIDER, CAVITY POWER DIVIDER AND MANUFACTURING METHOD THEREOF

(75) Inventors: Shangchuan Sun, Shenzhen (CN); Endong Tong, Shenzhen (CN)

(73) Assignee: SHENZHEN TAT FOOK TECHNOLOGY CO., LTD., Shenzhen, Guangdong Province (CN)

( * ) Notice: Subject to any disclaimer, the term of this patent is extended or adjusted under 35 U.S.C. 154(b) by 184 days.

(21) Appl. No.: 13/994,758

(22) PCT Filed: Dec. 2, 2011

(86) PCT No.: PCT/CN2011/083359

§ 371 (c)(1),
(2), (4) Date: Aug. 31, 2013

(87) PCT Pub. No.: WO2012/079470

PCT Pub. Date: Jun. 21, 2012

(65) Prior Publication Data

US 2013/0335162 A1 Dec. 19, 2013

(30) Foreign Application Priority Data

Dec. 16, 2010 (CN) ..... 2010 1 0594529
Dec. 16, 2010 (CN) ..... 2010 1 0594544

(51) Int. Cl.
*H01P 5/20* (2006.01)
*H01P 5/12* (2006.01)

(52) U.S. Cl.
CPC ..... *H01P 5/12* (2013.01); *Y10T 29/49826* (2015.01)

(58) Field of Classification Search
USPC ..... 333/127
See application file for complete search history.

(56) References Cited

U.S. PATENT DOCUMENTS

2004/0222867 A1* 11/2004 Antkowiak ..... 333/127
2006/0022298 A1* 2/2006 Shiraishi et al. ..... 257/509

FOREIGN PATENT DOCUMENTS

| | | | |
|---|---|---|---|
| CN | 2715363 | Y | 8/2005 |
| CN | 101553952 | A | 10/2009 |
| CN | 101807735 | A | 8/2010 |
| CN | 201576730 | U | 9/2010 |
| CN | 102122745 | A | 7/2011 |
| CN | 102122746 | A | 7/2011 |
| CN | 201936983 | U | 8/2011 |
| CN | 201936984 | U | 8/2011 |
| CN | 202050044 | U | 11/2011 |
| JP | 2004-015411 | A | 1/2004 |

* cited by examiner

*Primary Examiner* — Daniel Puentes
(74) *Attorney, Agent, or Firm* — Cheng-Ju Chiang

(57) ABSTRACT

Embodiments of the present disclosure disclose an inner connecting element of a cavity power divider, the cavity power divider and a manufacturing method thereof. Two ends of the inner connecting element of the cavity power divider are respectively an input end and an output end, and the inner connecting element of the cavity power divider is in a sheet form. The cavity power divider comprises a cavity and at least three connectors. The cavity is provided with one connector at an input end thereof and with at least two connectors at an output end thereof. The connecting element is included in the cavity, with the input end and the output end of the connecting element being connected respectively with the connectors at the input end and the output end of the cavity.

9 Claims, 7 Drawing Sheets

INNER CONNECTING ELEMENT OF A CAVITY POWER DIVIDER, CAVITY POWER DIVIDER AND MANUFACTURING METHOD THEREOF

FIELD OF THE INVENTION

The present disclosure generally relates to the technical field of communications, and more particularly, to an inner connecting element of a cavity power divider, the cavity power divider and a manufacturing method of the cavity power divider.

BACKGROUND OF THE INVENTION

FIGS. 1 and 2 show a structure of a conventional cavity power divider. The cavity power divider comprises connectors 1 and a cavity 2 which has a rectangular cross section. The cavity 2 is provided with one connector at an input end thereof and four connectors at an output end thereof. Each of the connectors comprises an inner conductor 4 therein. Also, a connecting rod 3 in the form of a stepped round body is included in the cavity 2. An end of the connecting rod 3 is connected to the inner conductor of the connector disposed at the input end, and the other end of the connecting rod 3 is connected to inner conductors of the connectors disposed at the output end. The connecting rod 3 is made of copper through a machining process and has a diameter gradually increasing from the input end to the output end. The connectors are fabricated separately from and then movably connected with the cavity. In order to meet the requirements for outdoor use, seal rings 5 are additionally provided at interfaces between the connectors and the cavity for the waterproof purpose.

However, through researches on the prior art, the present inventor has found that: in the conventional cavity power divider, the connecting rod in the cavity power divider is formed through a machining process, and the cavity and the connectors are fabricated separately from each other, so assembly of the cavity power divider is complex, inefficient, time-consuming and costly.

SUMMARY OF THE INVENTION

In order to solve the problem that assembly of the conventional cavity power dividers is complex, inefficient, time-consuming and costly, embodiments of the present disclosure disclose an inner connecting element of a cavity power divider and the cavity power divider.

A solution adopted by embodiments of the present disclosure to solve the aforesaid technical problem is an inner connecting element of a cavity power divider, which comprises an input end and an output end and is in a sheet form.

Embodiments of the present disclosure also provide a cavity power divider, which comprises a cavity and at least three connectors. The cavity is provided with one of the connectors at an input end thereof and at least two of the connectors at an output end thereof, and the connecting element described above is included in the cavity, with the input end and the output end of the connecting element being connected with the input end and the output end of the cavity respectively.

Embodiments of the present disclosure further provide a manufacturing method of a cavity power divider. The cavity power divider comprises a cavity, connectors located at an input end and an output end of the cavity respectively, a connecting element and a cover plate. The manufacturing method comprises the following steps of: press-casting the cavity into an integral form; placing the connecting element in the cavity and connecting the connectors with the input end and the output end of the cavity respectively; and covering the cavity with the cover plate.

According to the inner connecting element of a cavity power divider, the cavity power divider and the manufacturing method of the cavity power divider disclosed in embodiments of the present disclosure, the cavity is formed through press casting, so the connecting element can be directly placed in the cavity during assembly. Thereby, so the cavity power divider is simple in structure, convenient to assemble, inexpensive, and convenient for mass production as compared with the prior art.

BRIEF DESCRIPTION OF THE DRAWINGS

To describe the technical solutions of embodiments of the present disclosure more clearly, the attached drawings necessary for description of the embodiments will be introduced briefly hereinbelow. Obviously, these attached drawings only illustrate some of the embodiments of the present disclosure, and those of ordinary skill in the art can further obtain other attached drawings according to these attached drawings without making inventive efforts. In the attached drawings.

DETAILED DESCRIPTION OF THE INVENTION

Figure 1:
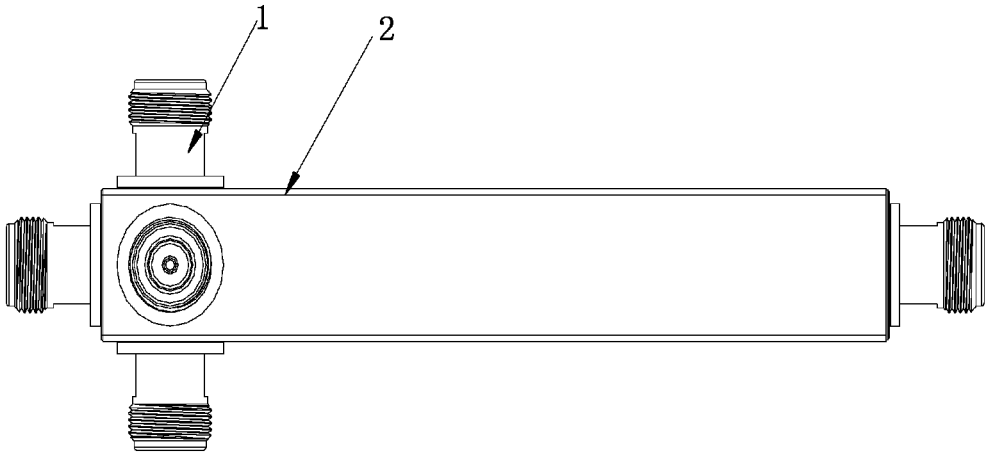
FIG. 1 (Prior Art)
FIG. 1 is a schematic structural view of a conventional cavity power divider.
Figure 2:
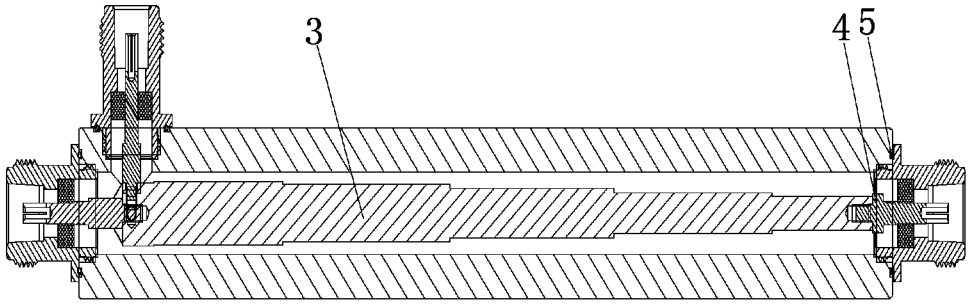
FIG. 2 (Prior Art)
FIG. 2 is a cross-sectional view showing internal structures of the conventional cavity power divider of FIG. 1.
Figure 3:
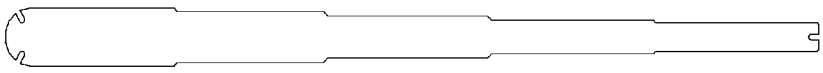
FIG. 3 is a schematic structural view of a first implementation of an inner connecting element of a cavity one-to-two power divider according to Embodiment 1 of the present disclosure.
Figure 4:
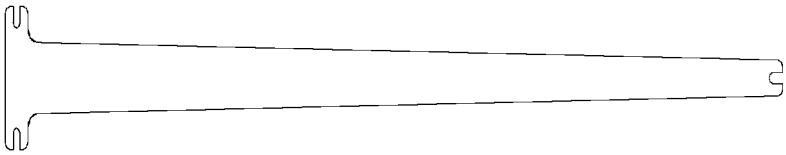
FIG. 4 is a schematic structural view of a second implementation of the inner connecting element of the cavity one-to-two power divider according to Embodiment 1 of the present disclosure.
Figure 5:
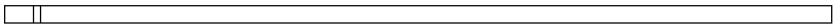
FIG. 5 is a side view of FIG. 4.
Figure 6:
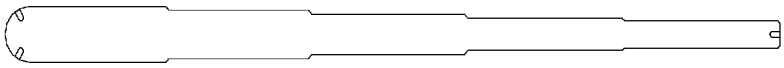
FIG. 6 is a schematic structural view of a third implementation of the inner connecting element of the cavity one-to-two power divider according to Embodiment 1 of the present disclosure.
Figure 7:
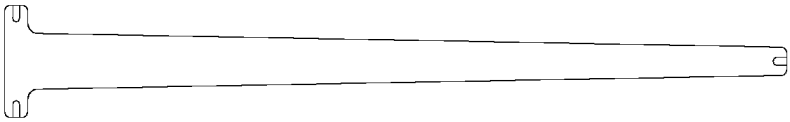
FIG. 7 is a schematic structural view of a fourth implementation of the inner connecting element of the cavity one-to-two power divider according to Embodiment 1 of the present disclosure.
Figure 8:
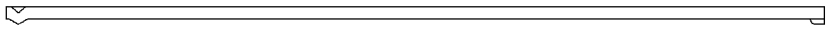
FIG. 8 is a side view of FIG. 7.
Figure 9:
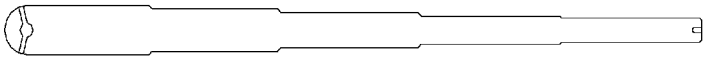
FIG. 9 is a schematic structural view of a fifth implementation of the inner connecting element of the cavity one-to-two power divider according to Embodiment 1 of the present disclosure.
Figure 10:
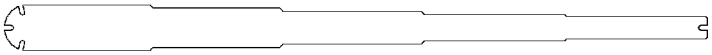
FIG. 10 is a schematic structural view of a first implementation of an inner connecting element of a cavity one-to-three power divider according to Embodiment 1 of the present disclosure.
Figure 11:
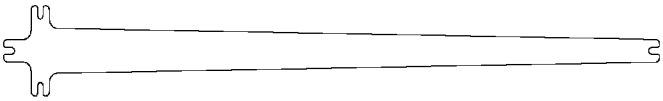
FIG. 11 is a schematic structural view of a second implementation of the inner connecting element of the cavity one-to-three power divider according to Embodiment 1 of the present disclosure.
Figure 12:
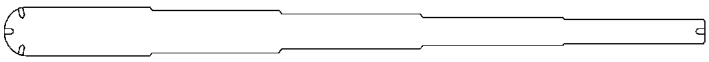
FIG. 12 is a schematic structural view of a third implementation of the inner connecting element of the cavity one-to-three power divider according to Embodiment 1 of the present disclosure.
Figure 13:
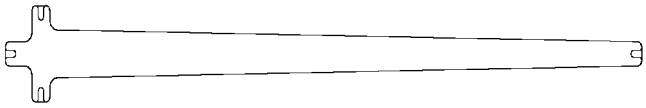
FIG. 13 is a schematic structural view of a fourth implementation of the inner connecting element of the cavity one-to-three power divider according to Embodiment 1 of the present disclosure.
Figure 14:
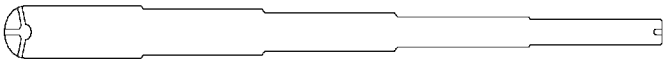
FIG. 14 is a schematic structural view of a fifth implementation of the inner connecting element of the cavity one-to-three power divider according to Embodiment 1 of the present disclosure.
Figure 15:
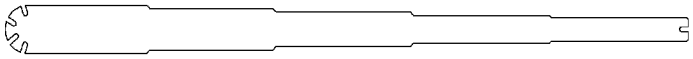
FIG. 15 is a schematic structural view of a fifth implementation of an inner connecting element of a cavity one-to-four power divider according to Embodiment 1 of the present disclosure.
Figure 16:
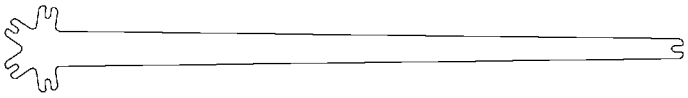
FIG. 16 is a schematic structural view of a second implementation of the inner connecting element of the cavity one-to-four power divider according to Embodiment 1 of the present disclosure.
Figure 17:
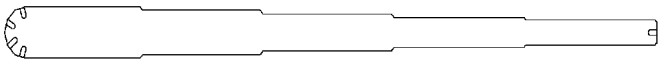
FIG. 17 is a schematic structural view of a third implementation of the inner connecting element of the cavity one-to-four power divider according to Embodiment 1 of the present disclosure.
Figure 18:
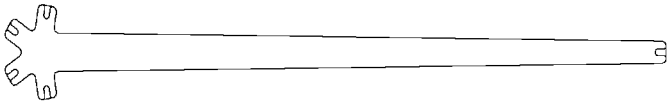
FIG. 18 is a schematic structural view of a fourth implementation of the inner connecting element of the cavity one-to-four power divider according to Embodiment 1 of the present disclosure.
Figure 19:
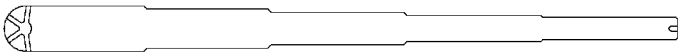
FIG. 19 is a schematic structural view of a fifth implementation of the inner connecting element of the cavity one-to-four power divider according to Embodiment 1 of the present disclosure.

Hereinbelow, technical solutions of embodiments of the present disclosure will be described clearly and completely with reference to the attached drawings. Obviously, embodiments described herein are only some of but not all of the embodiments of the present disclosure. All other embodiments that can be obtained without making inventive efforts by those of ordinary skill in the art upon reviewing the disclosures of the embodiments of the present disclosure shall fall within the scope of the present disclosure.

Embodiments of the present disclosure provide an inner connecting element of a cavity power divider, which comprises an input end and an output end and is in a sheet form.

Embodiments of the present disclosure also provide a cavity power divider, which comprises a cavity and at least three connectors. The cavity is provided with one of the connectors at an input end thereof and at least two of the connectors at an output end thereof, and the connecting element described above is included in the cavity, with the input end and the output end of the connecting element being connected with the input end and the output end of the cavity respectively.

Hereinbelow, the present disclosure will be detailed with reference to the attached drawing and embodiments thereof.

Embodiment 1

An inner connecting element of a cavity power divider, which comprises an input end and an output end and is in a sheet form.

In an implementation, the inner connecting element of the cavity power divider increases in width gradually from the input end to the output end.

In another implementation, the inner connecting element of the cavity power divider increases in size in a stepped manner from the input end to the output end.

In a first implementation, the inner connecting element of the cavity power divider is formed with U-shaped notches at the input end and the output end thereof respectively, and specifically, is formed with one U-shaped notch at the input end thereof and formed with at least two U-shaped notches at the output end thereof; the at least two U-shaped notches at the output end are distributed uniformly, and the U-shaped notches are connected with connectors of the cavity power divider respectively.

In a second implementation, the inner connecting element of the cavity power divider is formed with at least two feelers at the output end thereof, the feelers are evenly distributed, and the U-shaped notches are disposed at ends of the feelers respectively and are connected with the connectors of the cavity power divider respectively.

In a third implementation, the inner connecting element of the cavity power divider is formed with one groove at the input end thereof and formed with at least two grooves at the output end thereof, the grooves at the output end are distributed uniformly, and the grooves are connected with the connectors of the cavity power divider respectively.

In a fourth implementation, the inner connecting element of the cavity power divider is formed with at least two feelers at the output end thereof, the feelers are evenly distributed, and the grooves are disposed at ends of the feelers respectively and are connected with the connectors of the cavity power divider respectively.

In a fifth implementation, the inner connecting element of the cavity power divider is formed with one groove at the input end thereof and formed with at least two grooves at the output end thereof, the at least two grooves at the output end extend inwards to meet each other, and the grooves are connected with the connectors of the cavity power divider respectively.

The inner connecting element of the cavity power divider may be a copper sheet, an aluminum sheet or an iron sheet, and is preferably a copper sheet.

FIGS. 3 to 9 are schematic structural views of different implementations of a connecting element for use in a cavity one-to-two power divider.

FIGS. 10 to 14 are schematic structural views of different implementations of a connecting element for use in a cavity one-to-three power divider.

FIGS. 15 to 19 are schematic structural views of different implementations of a connecting element for use in a cavity one-to-four power divider.

The connecting element may be produced through punching directly, so it is simple to produce, inexpensive and convenient for mass production.

Embodiment 2

A cavity power divider, comprising a cavity and at least three connectors, wherein the cavity is provided with one of the connectors at an input end thereof and at least two of the connectors at an output end thereof, and an inner connecting element is included in the cavity, with an input end and an output end of the connecting element being connected with the input end and the output end of the cavity respectively.

The inner connecting element is in a sheet form. In a first implementation, the inner connecting element of the cavity power divider is formed with U-shaped notches at the input end and the output end thereof respectively, and specifically, is formed with one U-shaped notch at the input end thereof and formed with at least two U-shaped notches at the output end thereof; the at least two U-shaped notches at the output end are distributed uniformly, and the U-shaped notches are connected with connectors of the cavity power divider respectively.

In a second implementation, the inner connecting element of the cavity power divider is formed with at least two feelers at the output end thereof, the feelers are evenly distributed, and the U-shaped notches are disposed at ends of the feelers respectively and are connected with the connectors of the cavity power divider respectively.

In a third implementation, the inner connecting element of the cavity power divider is formed with one groove at the input end thereof and formed with at least two grooves at the input end thereof, the grooves at the output end are distributed uniformly, and the grooves are connected with the connectors of the cavity power divider respectively.

In a fourth implementation, the inner connecting element of the cavity power divider is formed with at least two feelers at the output end thereof, the feelers are evenly distributed, and the grooves are disposed at ends of the feelers respectively and are connected with the connectors of the cavity power divider respectively.

In a fifth implementation, the inner connecting element of the cavity power divider is formed with one groove at the input end thereof and formed with at least two grooves at the input end thereof, the at least two grooves at the output end extend inwards to meet each other, and the grooves are connected with the connectors of the cavity power divider respectively.

The inner connecting element of the cavity power divider increases in width gradually from the input end to the output end. In another implementation, the inner connecting element of the cavity power divider increases in size in a stepped manner from the input end to the output end.

The inner connecting element of the cavity power divider may be a copper sheet, an aluminum sheet or an iron sheet.

The cavity and the connectors are formed integrally. The output end of the cavity is arc-shaped.

The connectors at the arc-shaped output end are distributed uniformly.

Each of the connectors comprises an outer conductor, an inner conductor and an insulator. The outer conductor is integrally formed with the cavity, the inner conductor is disposed within the outer conductor and connected with the connecting element, and the insulator is disposed between the outer conductor and the inner conductor to separate the outer conductor and the inner conductor from each other and to prevent entry of foreign matters into the cavity.

The cavity power divider further comprises a cover plate for covering the cavity, and the cover plate and the cavity are welded together by laser.

In this embodiment, the cavity and the connectors are formed integrally. Forming the cavity and the connectors integrally improves the stability of the product, reduces the cost of the connectors and satisfies the water-proof requirement for the connectors.

The cover plate and the cavity are connected through welding by laser, so the assembly process is simple.

The cavity is formed through press casting, and the connector threads and inner bores are all formed through press casting, so no further machining is needed.

The cavity is formed through press casting; or alternatively, the outer cylindrical profiles of the threads and the inner bores are firstly formed through casting, and then the threads are machined into shape. This can save the production time and reduce the cost.

The connecting element is formed of a copper sheet through punching, which reduces the cost of both the raw material and the machining process.

Embodiment 3

Figure 20:
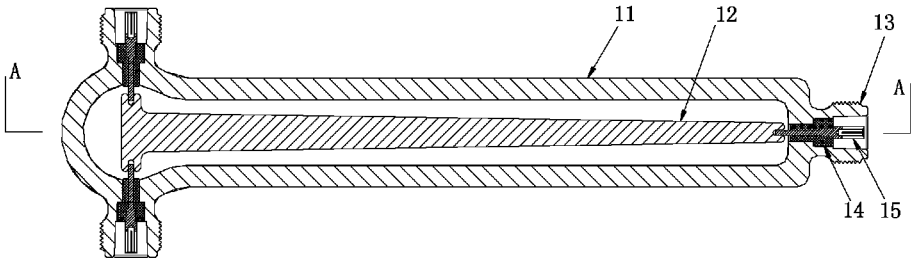
FIG. 20 is a cross-sectional view of a cavity one-to-two power divider according to Embodiment 3 of the present disclosure.
Figure 21:
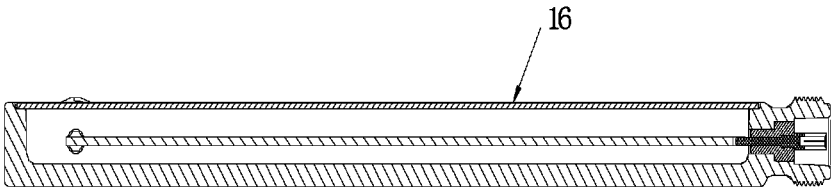
FIG. 21 is a cross-sectional view taken along a line A-A in FIG. 20.

As shown in FIG. 20 and FIG. 21, a cavity one-to-two power divider comprises a cavity 11, three connectors and a connecting element 12. The cavity is provided with one connector at an input end thereof and with two connectors at an output end thereof. The connecting element 12 is in a sheet form, and an input end and an output end of the connecting element are connected with the connectors respectively. The cavity 11 and the connectors are formed integrally.

The connecting element 12 is in a sheet form. The connecting element is as described in any of the implementations of Embodiment 1 shown in FIGS. 3 to 9.

Each of the connectors comprises an outer conductor 13, an inner conductor 15 and an insulator 14. The outer conductor 13 is integrally formed with the cavity 11; the inner conductor 15 is disposed within the outer conductor 13 and connected with the connecting element; and the insulator is disposed between the outer conductor and the inner conductor to separate the outer conductor and the inner conductor from each other and to prevent entry of foreign matters into the cavity.

The cavity is provided with one connector at the input end thereof and with two connectors at the output end thereof. The output end of the cavity is arc-shaped, with the two connectors being located at two ends of the arc shape respectively.

The cavity one-to-two power divider further comprises a cover plate 16 for covering the cavity, and the cover plate and the cavity are welded together by laser.

In the cavity one-to-two power divider of this embodiment, the cavity and the connectors are formed integrally. Forming the cavity and the connectors integrally improves the stability of the product, reduces the cost of the connectors and satisfies the water-proof requirement for the connectors.

The cover plate and the cavity are connected through welding by laser, so the assembly process is simple.

The cavity is formed through press casting, and the connector threads and inner bores are all formed through press casting, so no further machining is needed.

The cavity is formed through press casting; or alternatively, the outer cylindrical profiles of the threads and the inner bores are firstly formed through casting, and then the threads are machined into shape. This can save the production time and reduce the cost.

The connecting element is formed of a copper sheet through punching, which reduces the cost of both the raw material and the machining process.

Embodiment 4

Figure 22:
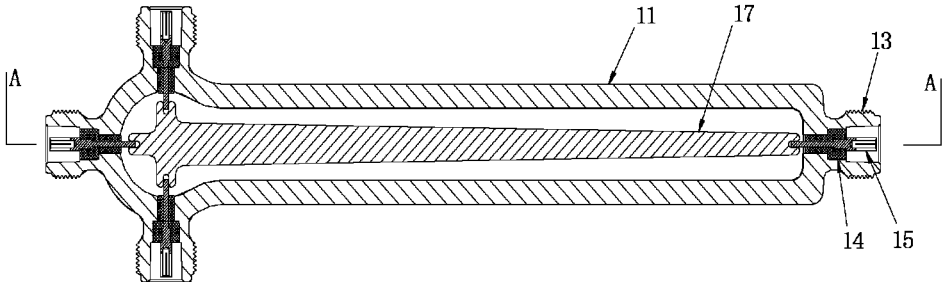
FIG. 22 is a cross-sectional view of a cavity one-to-three power divider according to Embodiment 4 of the present disclosure.
Figure 23:
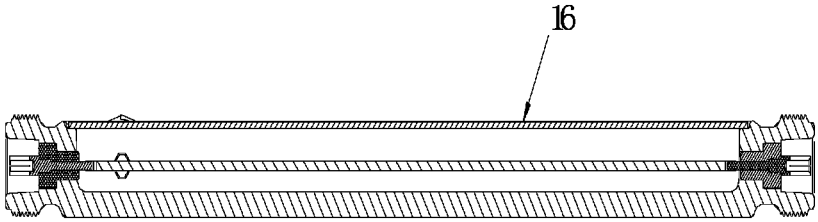
FIG. 23 is a cross-sectional view taken along a line A-A in FIG. 22.
Figure 24:
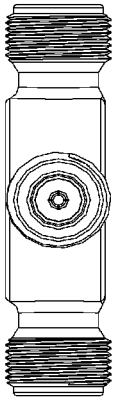
FIG. 24 is a front view of a cavity one-to-three power divider according to Embodiment 4 of the present disclosure.

As shown in FIGS. 22 to 24, a cavity one-to-three power divider comprises a cavity 11, four connectors and a connecting element 17. The cavity is provided with one connector at an input end thereof and with three connectors at an output end thereof. The connecting element 17 is in a sheet form, and an input end and an output end of the connecting element are connected with the connectors respectively. The cavity 11 and the connectors are formed integrally.

The connecting element 17 is in a sheet form. The connecting element is as described in any of the implementations of Embodiment 1 shown in FIGS. 10 to 14.

The connecting element increases in width gradually from the input end to the output end.

In another implementation, the connecting element increases in size in a stepped manner from the input end to the output end.

Each of the connectors comprises an outer conductor 13, an inner conductor 15 and an insulator 14. The outer conductor 13 is integrally formed with the cavity 11; the inner conductor 15 is disposed within the outer conductor 13 and connected with the connecting element; and the insulator is disposed between the outer conductor and the inner conductor to separate the outer conductor and the inner conductor from each other and to prevent entry of foreign matters into the cavity.

The cavity is provided with one connector at the input end thereof and with three connectors at the output end thereof. The output end of the cavity is arc-shaped, and the three connectors are distributed on the arc shape of the output end uniformly, with two of the three connectors being located at two ends of the arc shape respectively and the third one being located at the apex of the arc shape.

The cavity one-to-three power divider further comprises a cover plate 16 for covering the cavity, and the cover plate and the cavity are welded together by laser.

In the cavity one-to-three power divider of this embodiment, the cavity and the connectors are formed integrally. Forming the cavity and the connectors integrally improves the stability of the product, reduces the cost of the connectors and satisfies the water-proof requirement for the connectors.

The cover plate and the cavity are connected through welding by laser, so the assembly process is simple.

The cavity is formed through press casting, and the connector threads and inner bores are all formed through press casting, so no further machining is needed.

The cavity is formed through press casting; or alternatively, the outer cylindrical profiles of the threads and the inner bores are firstly formed through casting, and then the threads are machined into shape. This can save the production time and reduce the cost.

The connecting element is formed of a copper sheet through punching, which reduces the cost of both the raw material and the machining process.

Embodiment 5

Figure 25:
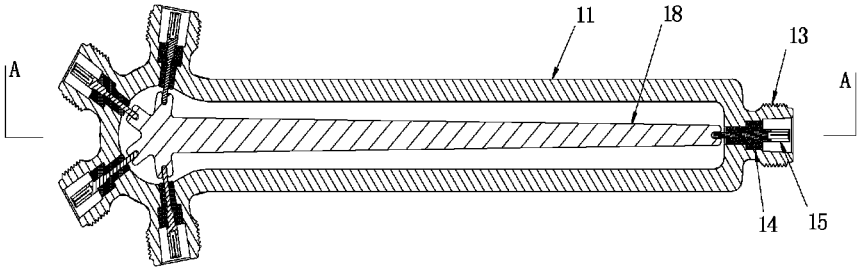
FIG. 25 is a cross-sectional view of a cavity one-to-four power divider according to Embodiment 5 of the present disclosure.
Figure 26:
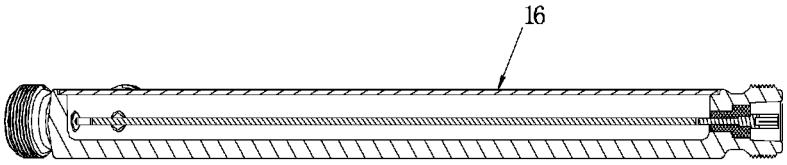
FIG. 26 is a cross-sectional view taken along a line A-A in FIG. 25.
Figure 27:
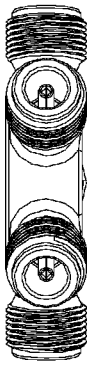
FIG. 27 is a front view of a cavity power divider according to Embodiment 5 of the present disclosure.

As shown in FIGS. 25 to 27, a cavity one-to-four power divider comprises a cavity 11, five connectors and a connecting element 18. The cavity is provided with one connector at an input end thereof and with four connectors at an output end thereof. The connecting element 18 is in a sheet form, and an input end and an output end of the connecting element are connected with the connectors respectively. The cavity 11 and the connectors are formed integrally.

The connecting element 18 is in a sheet form. The connecting element is as described in any of the implementations of Embodiment 1 shown in FIGS. 15 to 19.

The connecting element increases in width gradually from the input end to the output end.

In another implementation, the connecting element increases in size in a stepped manner from the input end to the output end.

Each of the connectors comprises an outer conductor 13, an inner conductor 15 and an insulator 14. The outer conductor 13 is integrally formed with the cavity 11; the inner conductor 15 is disposed within the outer conductor 13 and connected with the connecting element; and the insulator is disposed between the outer conductor and the inner conductor to separate the outer conductor and the inner conductor from each other and to prevent entry of foreign matters into the cavity.

The cavity is provided with one connector at the input end thereof and with four connectors at the output end thereof. The output end of the cavity is arc-shaped, and the three connectors are distributed on the arc shape of the output end uniformly, with two of the three connectors being located at two ends of the arc shape respectively and the other two being distributed uniformly on the arc shape.

The cavity one-to-four power divider further comprises a cover plate 16 for covering the cavity, and the cover plate and the cavity are welded together by laser.

In the cavity one-to-four power divider of this embodiment, the cavity and the connectors are formed integrally. Forming the cavity and the connectors integrally improves the stability of the product, reduces the cost of the connectors and satisfies the water-proof requirement for the connectors.

The cover plate and the cavity are connected through welding by laser, so the assembly process is simple.

The cavity is formed through press casting, and the connector threads and inner bores are all formed through press casting, so no further machining is needed.

The cavity is formed through press casting; or alternatively, the outer cylindrical profiles of the threads and the inner bores are firstly formed through casting, and then the threads are machined into shape. This can save the production time and reduce the cost.

The connecting element is formed of a copper sheet through punching, which reduces the cost of both the raw material and the machining process.

Embodiment 6

A manufacturing method of a cavity power divider, the cavity power divider comprising a cavity, connectors located at an input end and an output end of the cavity respectively, a connecting element and a cover plate, the manufacturing method comprising the following steps of:

press-casting the cavity into an integral form;

placing the connecting element in the cavity and connecting the connectors with the input end and the output end of the cavity respectively; and covering the cavity with the cover plate.

Press-casting the cavity comprises the following steps:

Step 1: assembling the mold and feeding a molten metal alloy;

Step 2: injecting at a low speed to fill the pressure chamber;

Step 3: injecting at a low speed to introduce the molten metal alloy into a runner;

Step 4: injecting at a high speed to fill the molten metal alloy into a mold cavity quickly;

Step 5: injecting at a low speed; and

Step 6: pressurizing to ensure that the mold is filled up.

Figure 28:
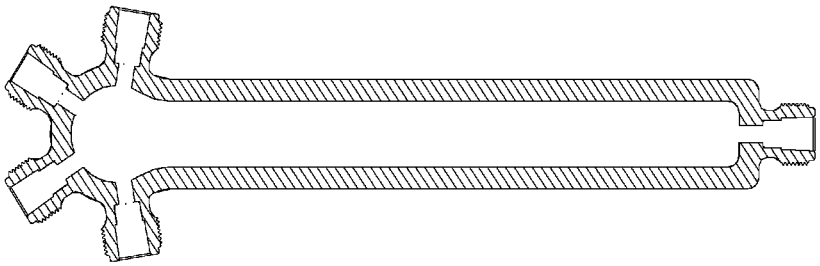
FIG. 28 is a cross-sectional view of a cavity of a cavity power divider according to Embodiment 6 of the present disclosure.

The output end of the cavity is press-cast into an arc shape. As shown in FIG. 28, press-casting the cavity into an integral form further comprises: press-casting the cavity and the connectors into an integral form, and forming threads on the connectors directly.

In another implementation, the cavity and the connectors are press-cast firstly, and then threads are machined on the connectors. This can ensure that the connector threads are produced more precisely.

Figure 29:
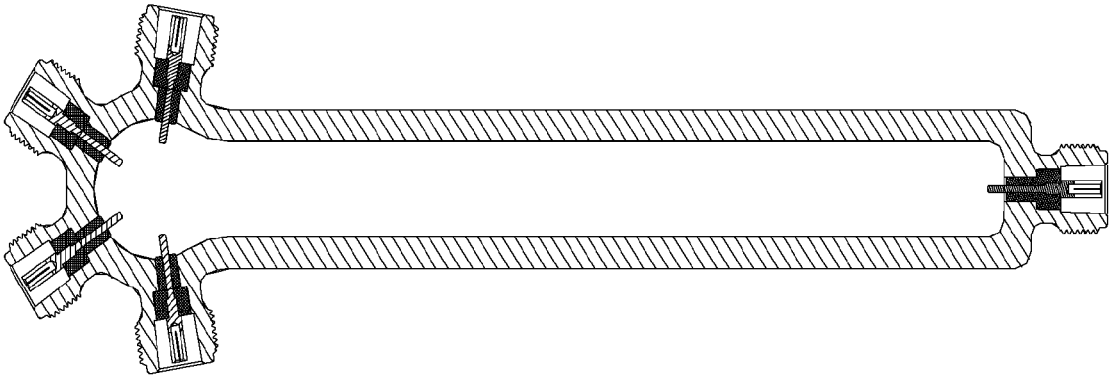
FIG. 29 is a cross-sectional view of a cavity of a cavity power divider according to Embodiment 6 of the present disclosure.
Figure 30:
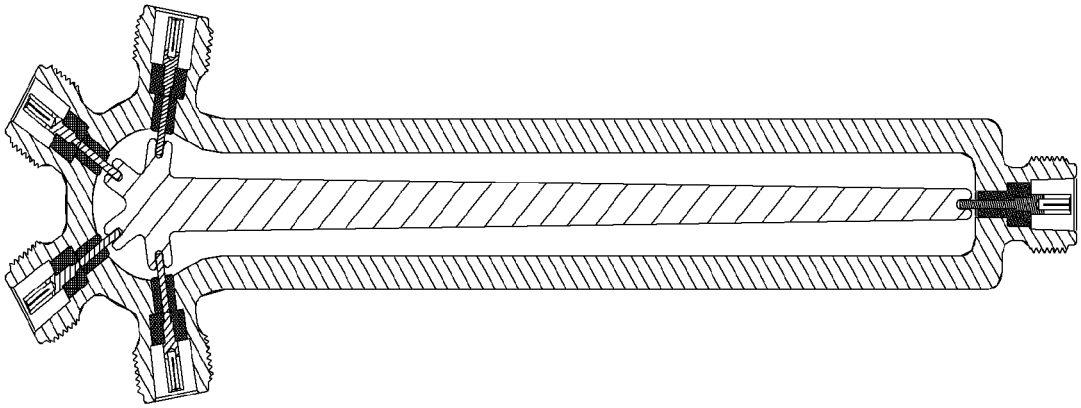
FIG. 30 is a cross-sectional view of a cavity power divider according to Embodiment 6 of the present disclosure.

As shown in FIG. 29, an insulator and an inner conductor are installed in each of the connectors, the connecting element is in a sheet form, and the manufacturing method further comprises the following step before placing the connecting element in the cavity: punching the sheet material into the sheet-like connecting element. Then, the connecting element is placed in the cavity and the connectors are connected with the inner conductors of the connectors disposed at the input end and the output end outside the cavity respectively, as shown in FIG. 30.

Covering the cavity with the cover plate comprises: welding the cover plate and the cavity together by laser.

According to the manufacturing method of a cavity power divider of this embodiment, the cavity is produced through press casting and the connecting element is placed in the cavity directly, so the cavity power divider can be produced through a simple process and at a low cost, and is convenient for mass production; meanwhile, forming the cavity and the connectors integrally improves the stability of the product, reduces the cost of the connectors and satisfies the waterproof requirement for the connectors; and punching the connecting element into a sheet form reduces the cost of both the raw material and the machining process. Moreover, welding the cover plate and the cavity together by laser makes the assembling process simple.

The aforesaid embodiments are provided only to exemplify the present disclosure, and upon reviewing the disclosures of this application, those skilled in the art can make various modifications on the aforesaid description without departing from the spirits and scope of the present disclosure.

What is claimed is:

1. A cavity power divider, comprising a cavity and at least three connectors, wherein the cavity is provided with one of the connectors at an input end thereof and at least two of the connectors at an output end thereof, and a connecting element is included in the cavity, the connecting element comprises an input end and an output end, the input end and the output end of the connecting element are connected with the input end and the output end of the cavity respectively, and the connecting element is in a sheet form;

wherein the connecting element increases in width gradually from the input end to the output end thereof.

2. The cavity power divider of claim 1, wherein the output end of the cavity is arc-shaped.

3. The cavity power divider of claim 2, wherein the at least two of the connectors are distributed uniformly on the arc-shaped output end.

4. The cavity power divider of claim 3, wherein the cavity and the connectors are integrally formed.

5. The cavity power divider of claim 4, wherein each of the connectors comprises an outer conductor, an inner conductor and an insulator, the outer conductor is integrally formed with the cavity, the inner conductor is disposed within the outer conductor and connected with the connecting element, and the insulator is disposed between the outer conductor and the inner conductor to separate the outer conductor and the inner conductor from each other and to prevent entry of foreign matters into the cavity.

6. The cavity power divider of claim 1, further comprising a cover plate for covering the cavity.

7. The cavity power divider of claim 6, wherein the cover plate and the cavity are welded together by laser.

8. The cavity power divider of claim 1, wherein the connecting element is formed with one U-shaped notch at the input end thereof and formed with at least two U-shaped notches at the output end thereof such that the connecting element is connected to the one of the connectors at the input end of the cavity through the one U-shaped notch at the input end of the connecting element, and connected to the at least two of the connectors at the output end of the cavity through the at least two U-shaped notches at the output end of the connecting element.

9. The cavity power divider of claim 8, wherein the connecting element is formed with at least two feelers at the output end thereof, with the at least two U-shaped notches being disposed at ends of the at least two feelers respectively.

* * * * *